US005549538A

United States Patent [19]

Marsik

[11] Patent Number: 5,549,538

[45] Date of Patent: Aug. 27, 1996

[54] PROCESS FOR MANUFACTURING FLAP-STYLE SQUARE-BOTTOM BAGS

[75] Inventor: Ronald Marsik, Willow Springs, Ill.

[73] Assignee: Bagcraft Corporation of America, Chicago, Ill.

[21] Appl. No.: 174,410

[22] Filed: Dec. 28, 1993

[51] Int. Cl.[6] ..... B31B 31/86; B31B 35/26; B31B 39/60

[52] U.S. Cl. ..... 493/218; 493/217; 493/261; 493/264; 493/334; 493/933; 493/936

[58] Field of Search ..... 493/210, 217, 493/218, 223, 244, 245, 334, 335, 260, 261, 264, 933, 936, 194, 196, 198, 199, 201, 203, 349

[56] References Cited

U.S. PATENT DOCUMENTS

| | | | |
|---|---|---|---|
| 692,695 | 2/1902 | Mullen | 493/936 |
| 2,176,499 | 10/1936 | Hoppe | 493/264 |
| 2,246,911 | 6/1940 | Baker | 493/264 |
| 2,496,796 | 10/1947 | Kardon | 493/217 |
| 2,709,549 | 3/1952 | Haslacher | 493/217 |
| 3,466,981 | 9/1966 | Honsel | 493/261 |
| 3,690,221 | 9/1972 | Schmedding | 493/218 |
| 3,927,606 | 12/1975 | Brockmuller et al. | 493/218 |
| 4,226,172 | 10/1980 | Langen | 93/35 SB |
| 4,976,674 | 12/1990 | Yannuzzi | 493/217 |
| 5,102,383 | 4/1992 | Achelpohl | 493/218 |
| 5,149,315 | 9/1992 | Muhs | 493/189 |
| 5,314,252 | 4/1994 | Happ | 383/126 |
| 5,458,556 | 10/1995 | Hlubik | 493/244 |

*Primary Examiner*—Jack W. Lavinder
*Assistant Examiner*—Christopher W. Day
*Attorney, Agent, or Firm*—Seyfarth, Shaw, Fairweather & Geraldson

[57] ABSTRACT

A process for manufacturing a multi-ply square bottom bag having a front wall, a back wall, a pair of gusseted side walls, each of which join to said front and back walls. There is also formed a gusseted square bottom panel having spaced but substantially parallel gusset edges and said bottom is joined to the front, back and side walls. The bag is produced by providing a web of inner ply material and a web of outer ply material, adhesively joining said webs into a composite and forming said bag from said joined webs. The improvement relates to forming a first flap in the inner web by cutting the web so as to form a plurality of free edges and a hinge line for said flap. The hinge line is connected to the free edges so that the free edges and hinge line define the flap. Thereafter joining the inner and outer webs to form the composite web. The hinge line is generally transverse to the longitudinal axis of the web and the flap is formed in the inner web so as to be positioned adjacent the front wall and bottom wall with the hinge line at the junction thereof when said bag is formed and said flap is arranged to overlie the gusset edges in the bottom panel.

9 Claims, 2 Drawing Sheets

PROCESS FOR MANUFACTURING FLAP-STYLE SQUARE-BOTTOM BAGS

BACKGROUND OF THE INVENTION

This invention relates to a process for the manufacture of a square bottom bag having a flap or patch to overlie the bag bottom so as to minimize seepage and leakage from the bag through the bottom.

Square bottom or S.O.S. bags when opened have a squared or flat bottom. Moreover, when such bags are placed on a flat surface they tend to stand erect and are self supporting. These bags can be easy to load with items such as grocery items or restaurant items and have become increasingly popular.

The square bottom is formed by folding the bag ends which are in a sense extensions of the front, back and side walls. Various flaps and gussets are formed and folded so as to form the bottom. The two side wall extensions are folded inwardly and form gussets and parallel spaced edges which extend between the front and back walls. Liquids or granular materials may leak or seep from the bag through the bottom at these edges. Thus it has been proposed to fabricate square bottom bags with an internal flap which overlies the bottom so as to minimize seepage or leakage. See, for example, laid-open Canadian patent application, Serial No. 2,064, 181-9 filed Mar. 26, 1992.

That laid-open application discloses a separate flap that is applied to the inside of the bag and glue spots on the bottom, particularly between the parallel and spaced edges, to draw the flap down onto the bottom. But it has been found to be desirable to improve upon this structure. especially in connection with multi-ply square bottom bags.

Thus, it is an object of this invention to provide a process for manufacturing multi-ply bags with an internal bottom protecting flap or flaps.

It is another object to provide improvements to such a process that can be adapted to the standard process.

These and other objects of this invention will become apparent from the following disclosure and appended claims.

SUMMARY OF THE INVENTION

By this invention, multi-ply square bottom bags can be manufactured which include an internal bottom-overlying flap(s). The process includes die-cutting the flap(s) for overlying the bottom in the inner ply, during the bag forming process. More specifically, the flap(s) is cut into the web that forms the inner ply prior to that web being joined to the outer ply web and the bag being formed from the composite webs.

During the bag forming operation glue is applied to gussets used in forming the bag bottom and provides glue between the inner gusset edges so as to secure the flap(s) to the bottom.

It is sometimes desirable to form a bag with a primary flap, slightly smaller than the bottom so as to avoid side gusset interference and a secondary flap very much smaller than the bottom. The bag can be formed with the primary flap only or optionally also with a secondary flap. The primary flap is integral with the front wall and the secondary flap is integral with the back wall. Each are intended to overlie the space in the bottom between the gusset edges and to be secured to the bottom. A portion of the primary flap may also overlie the secondary flap. This bag system with a primary and a secondary flap can be made by the process described above where the flaps are formed from the inner ply, by die cutting the inner ply before the webs are joined and the bags are formed.

DESCRIPTION OF THE PREFERRED EMBODIMENT

Figure 1:
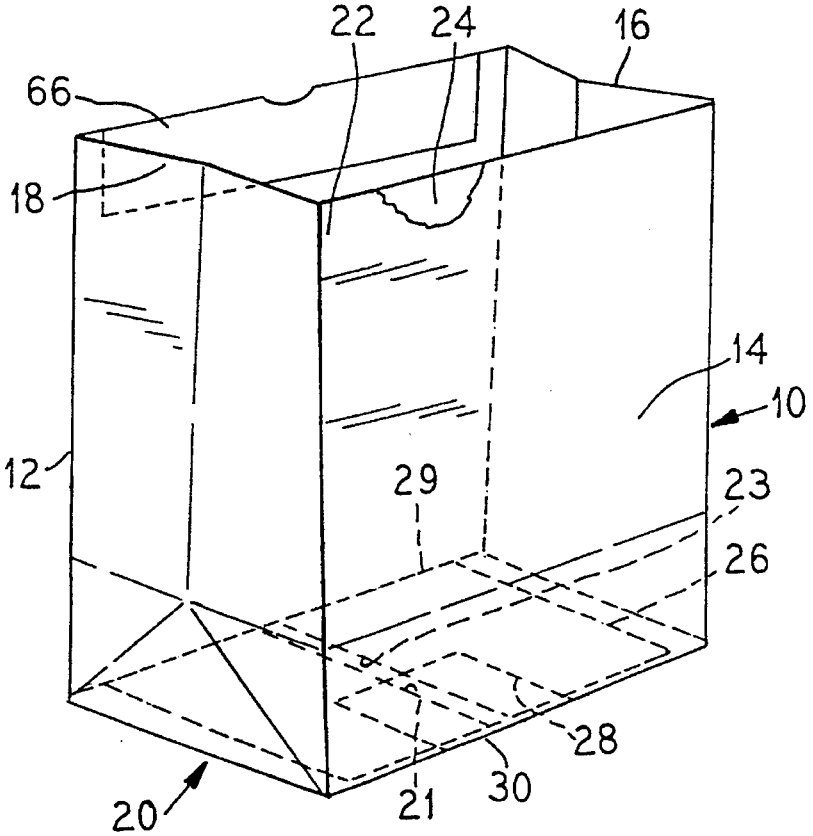
FIG. 1 is a perspective view of a bag made by the process of this invention.

Referring first to FIG. 1, there is shown a square bottom bag 10 generally, which includes a front wall 12, a back wall 14, and a pair of gusseted side walls 16 and 18 which join the front and back walls. A folded and gusseted square bottom 20 is provided and joined to the walls. The bottom 20 is fabricated from extensions of the walls which are folded and gusseted. The bottom portion inside the bag is formed by folds from the side walls which are folded inwardly and form two opposed, spaced and parallel edges 21 and 23 at about the center of the bottom which extend between the front and back walls.

The bag has two plies: an outer ply 22 and an inner ply 24. The inner ply has been die cut so as to form a primary internal flap 26 and a secondary internal flap 28. The primary flap is slightly smaller than the bottom and is intended to overlie most of the bottom and the space between the gusset edges. The primary flap is hinged at the bottom of the front wall along a line 29. Moreover, the primary flap 26 is intended to overlie the edges 21 and 23, which are normal to the front wall. The primary flap 26 is adhesively secured to the bottom in the gap formed by the edges 21 and 23 for a distance equal to about one-half the distance between the front and back walls and beginning at the front wall. Finally, the primary flap is rectangularly shaped and is integral with the inner ply and is joined to the front wall along a hinge or score line 29 at the junction of the front wall and bottom wall.

The secondary flap 28 is integral with the inner ply, is rectangularly shaped, and is hingedly connected to the inner ply along the back wall adjacent the bottom at line 30. The secondary flap is positioned to overlie the bottom gap for at least about one-half the distance between the front and back walls. In this embodiment, the secondary flap extends toward the front wall a distance slightly greater than one-half the front wall/back wall distance. But the secondary flap is significantly smaller than the primary flap. The hinge lines are generally transverse to the longitudinal axis of the bag-forming web.

Figure 2:
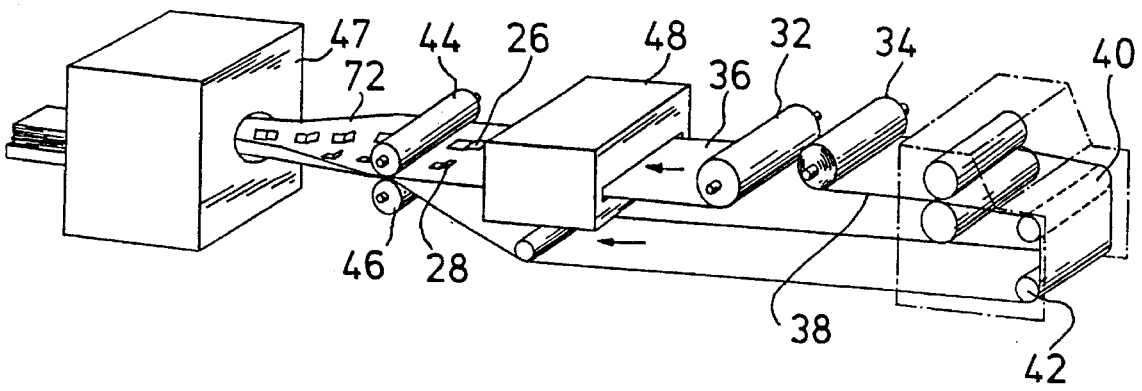
FIG. 2 is a diagrammatic view of the process of this invention.

The above-identified bag with a primary flap alone or a primary flap and a secondary flap is manufactured by the process shown diagrammatically in FIG. 2. Two supply rolls are provided; the first roll 32 is of inner ply material and the second roll 34 is of outer ply material. Webs of material 36 and 38 are drawn from each roll. The outer ply web may be directed through and about printing rolls such as 40 and 42 and then directed to the composite web forming rolls 44 and 46. The inner ply 36 is drawn from the supply roll 32 and is directed through a die cutting machine 48. In the machine 48, the web 36 is cut and scored so as to form the primary flap alone or both the primary and secondary flaps. In practice, these flap(s) are rectangularly shaped and cut along the leading and side edges so as to separate the edges from the web. The trailing edge of the flap is formed by a score line which connects the cut side edges. After leaving the die cutting machine 48, the web 36 is directed to the composite web forming rolls 44 and 46, where webs 36 and 38 are joined into a composite web 72.

From there the composite web 72 is shaped into a tube and passes through a standard bagmaking machine 47 which folds, cuts and dispenses finished bags.

Figure 3:
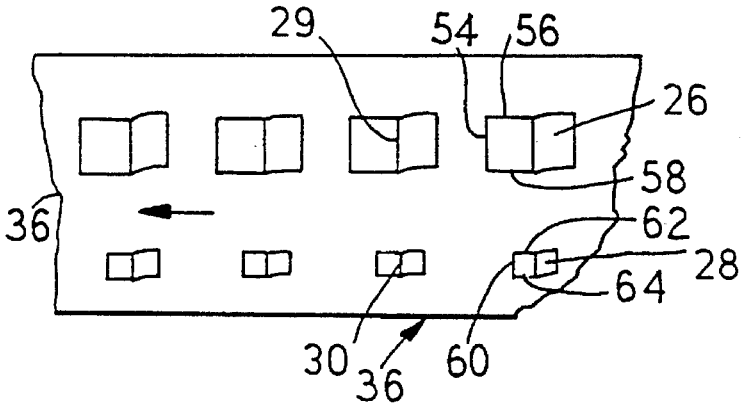
FIG. 3 is a plan view of the inner ply of the bag web and before formation of the bag.

Referring to FIG. 3, a part (or the repeat pattern) of the web 36 is shown. There is formed therein a primary flap 26 and a secondary flap 28. The primary flap includes a cut leading edge 54 and cut side edges 56 and 58. The secondary flap 28 includes a cut leading edge 60 and cut side edges 62 and 64. A transverse score line finishes formation of the flap by defining a hinge line 29 for the primary flap at its trailing edge and a hinge line 30 at the trailing edge of the secondary flap.

The flaps are positioned transversely on the web (i.e., transverse to the longitudinal axis of the web) so that when the web is folded to form a bag the primary flap 26 and hinge line 29 will be positioned at the junction of the front wall and the bottom wall with the flap being extendible into the bag interior. The secondary flap 28 hinge line 30 is to be positioned adjacent the back and bottom and so that the flap overlies the gap formed by the gusset edges.

The web for the internal ply is joined to the web for the external ply at the rolls 44 and 46. The outer ply 38 is in a lower position with the printed face facing outwardly or downwardly. The inner ply 36 is in an upper position with the flap(s) 26, 28 having been bent backward over the hinge line(s) 29, 30 so as to pass through the rolls 44 and 46 with the hinge leading.

At the rolls 44 and 46, a glue is applied, in various of the known ways, between the inner ply web and outer ply web to cause them to bond to each other to form a joined or composite web 72.

After exiting the joining rollers 44 and 46, the joined web is transported to a bag formation machine, as suggested by the black box area 47. In the machine, the joined web is servered, sometimes across the inner ply area from which the flap had been formed. Thus some fully formed bags may appear to have a notch or cutout 66 in the front wall in the inner ply 24 adjacent the bag top. This cutout does not adversely affect the function of the bag.

Figure 4:
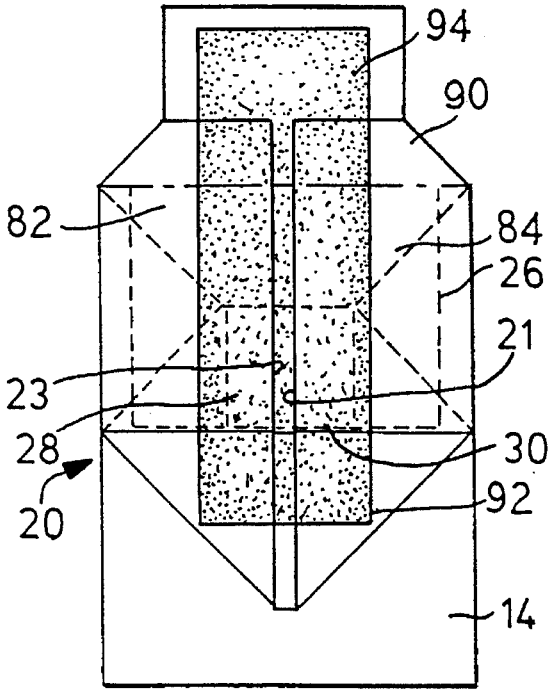
FIG. 4 is a view of the bottom of the bag open to show the glue pattern for gluing a primary and a secondary flap.

In the machine, among other things, the bottom of the bag is formed. This may be thought of as folding extensions of the front, back and side walls. A bottom is formed into the diamond-like configuration shown in FIG. 4. There the bottom 20 includes two rectangularly shaped members 82 and 84 that have been folded inwardly from the side panels. These two members end in spaced edges 21 and 23. These members 82 and 84 and their spaced edges 21 and 23 are seen from the bag interior as forming the bag bottom. The bottom also includes a pair of somewhat triangular flaps 90 and 92, each formed from either the front or back wall. These triangular flaps are each joined to the rectangular gusset-like members and are adapted to be folded thereover to form the bottom.

A glue pattern 94, shown as stippled, is applied to the bag bottom so as to bridge the edge gap and be applied over the rectangular gusset-like members 82 and 84 and the triangular members 90 and 92. On the inside of the bag and opposite the gap formed by the edges the primary 26 and secondary 28 flaps are positioned. Glue is also applied to these flaps during the bottom gluing process so that the primary and secondary flaps are held down against the bottom. After gluing, triangular flap 92 is folded against the gussets and glued in place. Then the other triangular flap 90 is folded thereover and glued in place.

Figure 5:
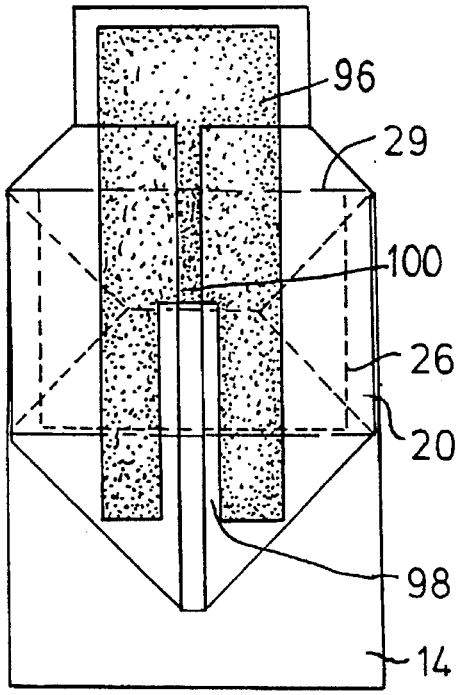
FIG. 5 is a view of the bottom of a bag open to show glue pattern for gluing only a primary flap.

If the system is used to manufacture a bag only with a primary flap, the glue pattern 96 is slightly different as seen in FIG. 5. Fundamentally a gap or space 98 is formed in the pattern surrounding the gusset edges and extending from the back wall a distance equal to about one-half the distance between the front wall to the back wall. But there the glue is applied to the bottom and both sides of the gap formed by the edges such as 21 and 23 and in the gap area for one-half the distance of the bottom and from the front wall thereof as suggested by numeral 100. This pattern thus applies glue to only one-half the primary flap extending from the front wall.

This invention has been described in connection with the embodiments described above but numerous changes and modifications can be made to this embodiment without departing from the spirit and scope of this invention.

I claim as my invention:

1. A process for manufacturing a multi-ply square bottom bag having a from wall, a back wall, a pair of gusseted side walls, each of which join to said front and back walls and a gusseted square bottom panel having spaced but substantially parallel gusset edges, said bottom joined to the front, back and side walls, said bag produced by providing a web of inner ply material and a web of outer ply material, adhesively joining said webs into a composite web having a longitudinal axis and forming said bag from said composite web and wherein the improvement comprises:

forming a first flap in said inner web by cutting said web so as to form a plurality of free edges and forming a hinge line for said flap, which line is connected to the free edges so that said free edges and hinge line define the flap;

thereafter joining the inner and outer webs;

wherein the hinge line is generally transverse to the longitudinal axis of the composite web; and wherein the flap is formed in the inner web so as to be positioned adjacent the front wall and the bottom wall with the hinge line at a junction thereof when said bag is formed and said flap arranged to overlie the gusset edges in the bottom panel.

2. An improved process as in claim 1, wherein there is provided a second flap in the inner web, said process includes the steps of:

forming a second flap in said inner web by cutting the web so as to form free edges and forming said hinge line for said second flap, which line is connected to the free edge so that said free edge and hinge line define the flap;

said secondary flap being formed at about the same time as the first flap is formed;

wherein the hinge line is generally transverse to the longitudinal axis of the web; and wherein the second flap is formed in the inner ply so as to be positioned adjacent the back wall and bottom wall with the hinge line at the junction thereof when the bag is formed and the second flap is arranged to overlie the gusset edges in the bottom panel.

3. An improved process as in claim 2, wherein one flap is of a size greater than the other flap.

4. An improved process as in claim 3, wherein the larger flap is the flap associated with the front wall.

5. An improved process as in claim 2, wherein during formation the first flap hinge line is aligned latitudinally with the second flap hinge line.

6. A process as in claim 1, wherein the first flap is rectangularly shaped.

7. A process as in claim 2, wherein the second flap is also rectangularly shaped.

8. A process as in claim 1, wherein said flap has a leading edge and a trailing edge and said hinge line is formed at the trailing edge of the flap so that said flap can position itself in overlying relation to the web during the manufacturing process.

9. A process for manufacturing a multi-ply square bottom bag having a front wall, a back wall, a pair of gusseted side walls, each of which join to said front and back walls and a gusseted square bottom panel having spaced but substantially parallel gusset edges, said bottom joined to the from, back and side walls, said bag produced by providing a web of inner ply material having a longitudinal axis and a web of outer ply material, adhesively joining said webs into a compartment and forming said bag from said joined webs and wherein the improvement comprises:

forming a first flap in said inner web by cutting said web so as to form a plurality of free edges and forming a hinge line of said flap, which line is connected to free edges so that said free edges and hinge line define the flap and thereafter joining the inner and outer webs;

the hinge line is generally transverse to the longitudinal axis of the inner web; and the flap is formed in the inner web so as to be positioned adjacent the front wall and the bottom wall with the hinge line at the junction thereof when said bag is formed and said flap arranged to overlie the gusset edges in the bottom panel;

there is provided a second flap in the inner web, said process includes the steps of:

forming a second flap in said inner web by cutting the web so as to form free edges and forming said hinge line for said second flap, which line is connected to the free edges so that said free edges and hinge line define the flap at about the same time as the primary flap is formed;

the hinge line is generally transverse to the longitudinal axis of the web;

the second flap is formed in the inner ply so as to be positioned adjacent the back wall and bottom wall with the hinge line at the junction thereof when the bag is formed and the second flap is arranged to overlie the gusset edges in the bottom panel;

one flap is of a size greater than the other flap and the larger flap is the flap associated with the front wall;

during formation the first flap hinge line and second flap hinge line are aligned;

the first flap and the second flap are each rectangularly shaped; and said flap has a leading edge and a trailing edge and said hinge line is formed at the trailing edge of the flap, relative to the direction of web movement, so that said flap can position itself in overlying relation to the web during the manufacturing process.

* * * * *